US010030491B2

(12) United States Patent
Pyecroft et al.

(10) Patent No.: US 10,030,491 B2
(45) Date of Patent: Jul. 24, 2018

(54) METHOD FOR INCREASING GAS RECOVERY IN FRACTURES PROXIMATE FRACTURE TREATED WELLBORES

(71) Applicant: NEXEN ENERGY ULC, Calgary (CA)

(72) Inventors: James Frederick Pyecroft, Canmore (CA); Jurgen Siegfried Lehmann, Calgary (CA); Omar El-Naggar, Calgary (CA)

(73) Assignee: NEXEN ENERGY ULC, Alberta (CA)

( * ) Notice: Subject to any disclaimer, the term of this patent is extended or adjusted under 35 U.S.C. 154(b) by 99 days.

(21) Appl. No.: 15/036,701

(22) PCT Filed: Nov. 17, 2014

(86) PCT No.: PCT/CA2014/000827

§ 371 (c)(1),
(2) Date: May 13, 2016

(87) PCT Pub. No.: WO2015/070335

PCT Pub. Date: May 21, 2015

(65) Prior Publication Data

US 2016/0281480 A1 Sep. 29, 2016

Related U.S. Application Data

(60) Provisional application No. 61/904,533, filed on Nov. 15, 2013, provisional application No. 61/909,741, filed on Nov. 27, 2013.

(51) Int. Cl.
*E21B 43/17* (2006.01)
*E21B 43/26* (2006.01)
(Continued)

(52) U.S. Cl.
CPC ..... *E21B 43/17* (2013.01); *E21B 43/26* (2013.01); *E21B 43/295* (2013.01);
(Continued)

(58) Field of Classification Search
None
See application file for complete search history.

(56) References Cited

U.S. PATENT DOCUMENTS 3,349,845 A * 10/1967 Holbert ..... E21B 7/061 166/250.1
3,500,913 A * 3/1970 Closmann ..... E21B 43/17 166/259
(Continued)

FOREIGN PATENT DOCUMENTS

| | | | |
|---|---|---|---|
| CA | 2820742 | A1 | 9/2013 |
| CN | 103233713 | A | 8/2013 |
| WO | 2005045192 | A1 | 5/2005 |

OTHER PUBLICATIONS

WIPO, International Search Report and Written Opinion for PCT Application No. PCT/CA2014/000827 dated Feb. 15, 2015.
(Continued)

*Primary Examiner* — Anuradha Ahuja
(74) *Attorney, Agent, or Firm* — Norton Rose Fulbright Canada LLP; Paul J. Field

(57) ABSTRACT

A process for producing gaseous hydrocarbon from a subterranean formation by hydraulically fracturing with injection of a liquid material under pressure such that a connecting fracture is generated extending between a lower injection well and an upper production well, where a gas-liquid interface is defined within the fracture or within the upper producing well, and producing gas across the gas-liquid interface.

12 Claims, 6 Drawing Sheets

(51) Int. Cl.

| | |
|---|---|
| ***E21B 43/16*** | (2006.01) |
| ***E21B 43/295*** | (2006.01) |
| ***E21B 43/30*** | (2006.01) |
| *E21B 43/20* | (2006.01) |

(52) U.S. Cl.
CPC ..... *E21B 43/305* (2013.01); *E21B 43/164* (2013.01); *E21B 43/20* (2013.01)

(56) References Cited

U.S. PATENT DOCUMENTS

| | | | | | |
|---|---|---|---|---|---|
| 3,863,709 | A | | 2/1975 | Fitch | |
| 3,878,884 | A | | 4/1975 | Raleigh | |
| 4,042,029 | A | * | 8/1977 | Offeringa | E21B 43/164 166/305.1 |
| 4,223,729 | A | | 9/1980 | Foster | |
| 4,832,122 | A | * | 5/1989 | Corey | B09C 1/002 166/266 |
| 5,261,489 | A | * | 11/1993 | Jennings, Jr. | E21B 43/17 166/271 |
| 5,322,126 | A | | 6/1994 | Scott, III | |
| 5,456,315 | A | * | 10/1995 | Kisman | E21B 43/247 166/245 |
| 5,900,544 | A | | 5/1999 | Weng et al. | |
| 6,119,776 | A | * | 9/2000 | Graham | E21B 43/17 166/245 |
| 6,729,394 | B1 | * | 5/2004 | Hassan | E21B 43/17 166/245 |
| 7,441,603 | B2 | | 10/2008 | Kaminsky et al. | |
| 9,494,025 | B2 | * | 11/2016 | Artus | E21B 43/17 |

OTHER PUBLICATIONS

WIPO, International Search Report and Written Opinion for PCT Application No. PCT/CA2013/000994 dated Apr. 7, 2014.
WIPO, International Preliminary Report on Patentability for or PCT Application No. PCT/CA2013/000994 dated Jun. 2, 2015.
International Property Office, Examination Report for GB Application No. GB 1509426.1 dated Jul. 3, 2015.
USPTO, Office Action for U.S. Appl. No. 14/092,246 dated Jun. 15, 2016.

* cited by examiner

METHOD FOR INCREASING GAS RECOVERY IN FRACTURES PROXIMATE FRACTURE TREATED WELLBORES

FIELD

The present disclosure relates to hydraulic fracturing for recovering gaseous hydrocarbon material from a reservoir.

BACKGROUND

Generally, shale gas exploration programs begin with vertical wells drilled at a chosen area, based on local knowledge of the geology of the area. Typically, there is enough knowledge within the oil and gas community in an area given past oil and gas exploration activities to warrant vertical well drilling. Shale rock bearing hydrocarbons are associated with conventional oil and gas plays since shale is considered the source of hydrocarbon found with-in the conventional reservoir is above and in some cases below the shale source rock. Because of this, wells will have been drilled in the area, and the location of the hydrocarbon rich shales are known through well control, (wells drilled in the area through the shale), formation outcrops at the surface, and seismic studies in the area that have defined the structures above and below the shale rock.

Typically, a hydrocarbon shale exploration company will drill a vertical well (or wells) that penetrates the shale at a point where local knowledge would suggest the presence of organic matter in the shale, that with time, depth of burial and temperature, has been converted to oil and gas, to a depth some distance below the shale to define: (a) the presence of hydrocarbon bearing rock, (b) permeability, (c) porosity, (d) water saturation, and (e) total organic content. In some cases whole formation core or sidewall core will be taken during the drilling process. As a minimum, the well would be logged with conventional oilfield logging tools to confirm the presence of above the basic reservoir fluids characteristics and to estimate mechanical rock properties. Once the reservoir layers have been evaluated and described in both reservoir characteristic and rock property terms, the exploration company will attempt to stimulate the shale intervals selectively from the bottom of the well up to the upper most interval of interest. Each interval will be fractured and each interval will be production tested. Hydrocarbon samples will be taken and a determination of the production potential will be made based on the pressure and rate responses.

Based on the success or failure of this vertical well test, the project will proceed accordingly. Successful vertical wells will typically be followed by a horizontal well test. Based on the productivity and fracture treatment responses, as well as reservoir description from core and well logs, a target interval will be selected, that both engineers and geologists believe will be the most suitable for fracture initiation and hydrocarbon production. Typically, these engineers and geologists will form judgments, based on total organic carbon in place from well logs, as to what rock is most brittle and likely to form extensive hydraulic fractures. In addition, formation layers that will act as fracturing barriers are considered. Well placement will often be in the most brittle rock that will create hydraulic fractures between two competent fracturing barriers, one above the target interval and one below the target interval. That said, there are cases where the target interval has been non-reservoir rock between two fracturing barriers where the fractures will extend out of the non-reservoir rock into brittle hydrocarbon bearing shale.

Successful horizontal multistage hydraulic fracture stimulation projects are often based on trial and error. In some cases, an operator has placed the horizontal wellbore low in the reservoir structure and on each new well progressively targeted wellbore intervals higher in the reservoir structure. The ability to successfully place large water fracs into each well is evaluated, as well as the production from each wellbore interval. Multiwell pads are considered once an understanding of the best target wellbore interval is selected in a specific development area.

Modern shale gas extraction methods involve drilling horizontal wells into shale gas reservoir rock. Then, hydraulic fracturing is typically used to produce the wells. Hydraulic fracturing is where water or other fluids are injected at sufficient pressures to exceed tensile strength of the rock fabric and overcome the in-situ least principal stress to form a fracture in the rock. This fracture provides a conduit to convey hydrocarbon and injected fluids to a horizontal wellbore. Commercial extraction of reservoir product, such as oil or gas, or combinations thereof, from certain subsurface rock formations, requires a wellbore extending through the formation to a reservoir. In order to increase recovery of oil and/or gas, or combinations thereof, from rock formations and reservoirs, wellbores may be stimulated through hydraulic fracturing, resulting in a fracture in the formation surrounding the wellbore. Typically wellbores are drilled in a pattern that benefits the most from the dominant hydraulic fracture direction. Wellbores may be placed side by side, in one example, in a substantial pitchfork fashion, such that wellbores are evenly spaced at a distance or proximity that permit efficiency in drainage of hydrocarbon liquid or gas, contained in the reservoir and fracture, into said wellbore.

If wellbores are drilled too far apart, an increasingly large portion of the desired reservoir product is left behind in the reservoir, and, particularly, in the fracture. It is well documented in the oil and gas industry that each hydraulic fracture, while intersecting reservoir rock at great distances from the wellbore, does not effectively produce oil and gas from the entire length of the fracture. It is accepted that up to 66% or more of the created fracture length will not contribute significantly to production. In other words, only 34% of the fracture may be contributing to overall hydrocarbon production.

The production of the well involves an initial clean up period where the injected fracturing fluid, such as water, is recovered along with increasing amounts of the hydrocarbon fluid. Normally, as the water is removed from the induced fracture, the hydrocarbon fluid replaces the water. A proppant, such as sand, is used to prop open the fractures during the production phase. This is an attempt to maintain fracture flow conductivity.

However, this conventional method fails when used in unconventional reservoirs. The flaw in this concept is that once water is produced from a fracture, (induced or reactivated natural fracture), the displacement of the fracture is reduced restricting the flow of water. It is understood in the industry that hydraulic fractures created in shale rock behave in a complex manner. The fractures can change propagation direction based on changes in the rock least principal stress field. This complex fracture network, while connected when swollen with injected fluids such as water, water and proppant, etc., will form pinch points that disconnect injected fluids from the source well where the fractures were initiated. These fracture fluids and gas are considered to be stranded and unrecoverable.

SUMMARY

In one aspect, there is provided a process for producing gaseous hydrocarbon material from a subterranean formation, comprising:

hydraulically fracturing the subterranean formation with a liquid treatment material such that a connecting fracture is generated, and the connecting fracture extends from the lower well to the upper well, and such that at least a fraction of the supplied liquid treatment material becomes disposed as fracture-disposed liquid material within an upper well production fluid passage network including at least an upper portion of the connecting fracture and the upper well, and such that the upper well production fluid passage network becomes at least partially filled with network-disposed liquid material including liquid material that is disposed within the connecting fracture, and with effect that a gas-liquid interface is defined with the upper well fluid passage network, and such that, in response to the hydraulic fracturing, gaseous hydrocarbon material is received within the connecting fracture portion and is conducted upwardly through the network-disposed liquid material, by at least buoyancy forces, and across the gas-liquid interface; and producing the gaseous hydrocarbon material that has become disposed above the gas-liquid interface within the upper well production fluid passage network, via the upper well.

In another aspect, there is provided a process for producing gaseous hydrocarbon material from a subterranean formation, comprising:

supplying liquid treatment material to the subterranean formation that includes a pre-existing connecting fracture extending from a lower well to an upper well, and such that stimulation of the subterranean formation is effected by the supplied liquid treatment material disposed within the connecting fracture, and such that at least a fraction of the supplied liquid treatment material becomes disposed as fracture-disposed liquid material within an upper well production fluid passage network including at least an upper portion of the connecting fracture and the upper well, and such that the upper well production fluid passage network becomes at least partially filled with fracture-disposed liquid material, and with effect that a gas-liquid interface is defined with the upper well fluid passage network, and such that, in response to the stimulation, gaseous hydrocarbon material becomes disposed within the connecting passage portion and is conducted upwardly through the fracture-disposed liquid material, by at least buoyancy forces, and across the gas-liquid interface; and producing the gaseous hydrocarbon material that has become disposed above the gas-liquid interface within the upper well production fluid passage network, via the upper well.

In another aspect, there is provided a process for producing gaseous hydrocarbon material from a subterranean formation, comprising:

providing a lower well and an upper well;

supplying liquid treatment material to the subterranean formation via the lower well to effect hydraulically fracturing of the subterranean formation such that a connecting fracture extends from the lower well to the upper well; and producing at least gaseous hydrocarbon material that has been received within the connecting fracture in response to the hydraulic fracturing, via the upper well.

In another aspect, there is provided a process for producing gaseous hydrocarbon material from a subterranean formation, comprising:

providing a lower well and an upper well within the subterranean formation, wherein the subterranean formation includes a pre-existing connecting fracture extending from the lower well to the upper well;

supplying liquid treatment material to the subterranean formation such that conduction of gaseous hydrocarbon material into the connecting fracture is stimulated; and producing at least gaseous hydrocarbon material that has been received within the connecting fracture in response to the stimulating, via the upper well.

In a further aspect, there is provided a process for producing gaseous hydrocarbon material from a subterranean formation comprising:

supplying treatment fluid via a first well to the subterranean formation at a first injection point that is disposed within the subterranean formation at an interface with the first well, wherein the first injection point is disposed within a first vertical plane; and supplying treatment fluid via a second well to the subterranean formation at one or more second injection points, wherein each one of the one or more second injection points, independently, being disposed: (a) within the subterranean formation at a respective interface with the second well, and (b) within a respective second vertical plane, such that one or more second vertical planes are provided;

wherein the first vertical plane is disposed in parallel relationship with the second vertical planes, and is spaced apart from the closest second vertical plane by a minimum distance of at least 25 meters.

In yet a further aspect, there is provided a process for producing gaseous hydrocarbon material from a subterranean formation comprising:

supplying treatment fluid via a first well to the subterranean formation at a plurality of first injection points, wherein each one of the first injection points, independently, is disposed: (a) within the subterranean formation at a respective interface with the first well, and (b) within a respective first vertical plane, such that a plurality of first vertical planes is defined; and supplying treatment fluid via a second well to the subterranean formation at a plurality of second injection points, wherein each one of the second injection points, independently, is disposed: (a) within the subterranean formation at a respective interface with the first well, and (b) within a respective second vertical plane, such that a plurality of second vertical planes is defined;

wherein at least one staggered first injection point is defined, wherein each one of the at least one staggered first injection point, independently, is a first injection point having a respective first vertical plane that is disposed in parallel relationship with the second vertical planes and is spaced apart from the closest second vertical plane by a minimum distance of at least 25 meters;

and wherein at least 75% of the total volume of treatment fluid, that is supplied to the formation via the first well, is supplied at the at least one staggered first injection point.

In yet another aspect, there is provided a process for producing gaseous hydrocarbon material from a subterranean formation comprising:

supplying treatment fluid via a first well to the subterranean formation through a first port defined within a casing that is lining the first well, wherein the first port is disposed within a first vertical plane; and supplying treatment fluid via a second well to the subterranean formation through one or more second ports defined within a casing that is lining the second well, wherein each one of the one or more second ports, independently, is disposed within a second vertical plane;

wherein the first vertical plane is disposed in parallel relationship with the second vertical planes and is spaced apart from the closest second vertical plane by a minimum distance of at least 25 meters.

In a further aspect, there is provided a process for producing gaseous hydrocarbon material from a subterranean formation comprising:

supplying treatment fluid via a first well to the subterranean formation through a plurality of first ports defined within a casing that is lining the first well, wherein each one of the first ports, independently, is disposed within a respective first vertical plane, such that a plurality of first vertical planes is defined; and supplying treatment fluid via a second well to the subterranean formation through a plurality of second ports defined within a casing that is lining the second well, wherein each one of the second ports, independently, is disposed within a respective second vertical plane, such that a plurality of second vertical planes is defined;

wherein at least one staggered first port is defined, wherein each one of the at least one staggered first port, independently, is a first port having a respective first vertical plane that is disposed in parallel relationship with the second vertical planes and is spaced apart from the closest second vertical plane by a minimum distance of at least 25 meters;

and wherein at least 75% of the total volume of treatment fluid, that is supplied to the formation via the first well, is supplied through the at least one staggered first port.

BRIEF DESCRIPTION OF THE DRAWINGS

In the drawings, embodiments of the invention are illustrated by way of example. It is to be expressly understood that the description and drawings are only for the purpose of illustration and as an aid to understanding, and are not intended as a definition of the limits of the invention.

Embodiments will now be described, by way of example only, with reference to the attached figures, wherein.

DETAILED DESCRIPTION

Figure 1:
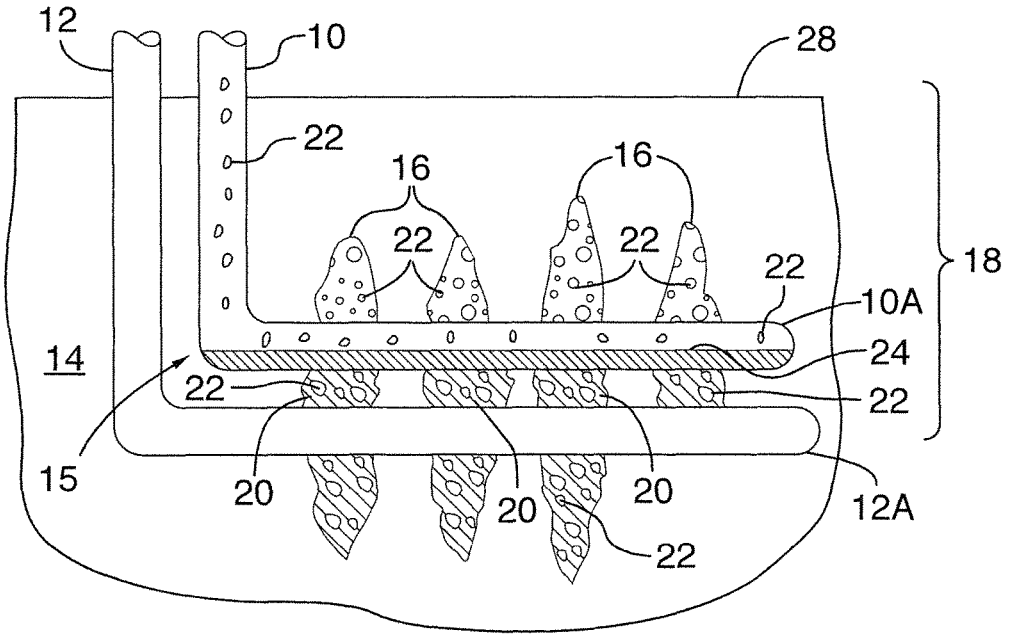
FIG. 1 is a schematic illustration of a side elevation view of an embodiment of a system used to implement the process within a subterranean formation, after gaseous hydrocarbon material has collected within the upper portion of the upper well production fluid passage network.
Figure 2:
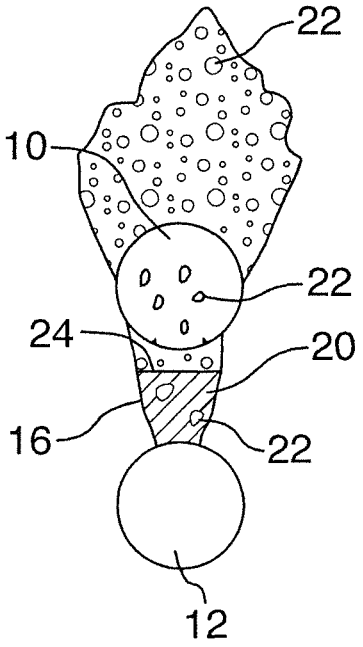
FIG. 2 is a schematic illustration of a view from the toe of the upper and lower wells illustrated in FIG. 1, with the gas-liquid interface having become further lowered by further collection of gaseous hydrocarbon material within the upper portion of the upper well production fluid passage network.

Referring now to FIGS. 1 and 2, there is provided an upper well 10 and a lower well 12. The upper and lower wells are disposed within a subterranean formation 14 and extend into the formation 14 from a surface 28. In some embodiments, for example, the subterranean formation 14 includes a subsea formation. The upper well 10 includes a horizontal portion 10A, and the lower well 12 includes a horizontal portion 12A, and both of the horizontal portions 10A, 12A are disposed within the formation 14. The horizontal portion 10A of the upper well 10 is disposed above the horizontal portion 12A of the lower well 12. It is understood that the horizontal portions 10A, 12A of the upper and lower wells 10, 12 may have varying inclinations along their trajectory.

The formation 14 includes a hydrocarbon-comprising reservoir 15 from which gaseous hydrocarbon material is produced by one or both of the wells 10, 12 (see below). In some embodiments, for example, one of the wells 10, 12 may be disposed outside of the hydrocarbon-comprising reservoir 15, such that the other one of the wells 10, 12 is disposed within the hydrocarbon-comprising reservoir 15, such that, the horizontal portion of the other one of the wells 10, 12 is also disposed within the hydrocarbon-comprising reservoir 15. In some embodiments, for example, the horizontal portion of both the wells 10, 12 is disposed outside of the hydrocarbon-comprising reservoir 15. In some embodiments, for example, the horizontal portions 10*a*, 12*a* of both of the wells 10, 12 is disposed within the hydrocarbon-comprising reservoir 15.

There is provided a method for producing gaseous hydrocarbon material 22 from a gaseous hydrocarbon-comprising reservoir 15.

Liquid treatment material is supplied to the formation 14 via the lower well 12, and effects hydraulic fracturing of the formation 14 such that a connecting fracture 16 is generated and the connecting fracture 16 extends from the lower well 12 to the upper well 10. In some embodiments, for example, the hydraulic fracturing effects generation of one or more fractures, and some or all of the generated fractures may be connecting fractures 16 that extend from the lower well 12 to the upper well 10. The entirety of the connecting fracture 16 may be a fracture that is generated by the hydraulic fracturing. Also, at least a portion of the connecting fracture may be generated by the hydraulic fracturing. In this respect, a pre-existing fracture (such as a naturally-occurring fracture) may already exist and extend from the lower well, and the supplying of the liquid treatment material effects extension of such fracture to the upper well 10 and thereby effect the generation of the connecting fracture. In some embodiments, for example, the liquid treatment material is supplied to the formation 14 via one or more ports provided in the lower well 12.

In some embodiments, for example, the liquid treatment material includes hydraulic fracturing fluid. Suitable hydraulic fracturing fluid includes water, water with various additives for friction reduction and viscosity such as polyacrylamide, guar, derivitized guar, xyanthan, and crosslinked polymers using various crosslinking agents, such as borate, metal salts of titanium, antimony, alumina, for viscosity improvements, as well as various hydrocarbon both volatile and non-volatile, such as lease crude, diesel, liquid propane, ethane and compressed natural gas, and natural gas liquids. In addition various compressed gases, such as nitrogen and/or CO2, may also be added, to water or other liquid materials.

In effecting the hydraulic fracturing, at least a fraction of the supplied liquid treatment material becomes disposed within an upper well production fluid passage network 18 to define a network-disposed liquid material. The upper well production fluid passage network 18 includes at least a portion of the connecting fracture 16 and the upper well 10. In this respect, the upper well production fluid passage network 18 is at least partially filled with fracture-disposed liquid material 20, such that the network-disposed liquid material includes the fracture-disposed liquid material 20. In some cases, such as for a time period immediately after the suspension of the supplying of the liquid treatment material to the formation 14, the network-disposed liquid material may also be disposed in the upper well. In operation, the upper well production fluid passage network 18 receives the gaseous hydrocarbon material 22 and effects production of the received at least gaseous hydrocarbon material 22.

In some embodiments, for example, the upper well production fluid passage network 18 includes the entirety of the connecting fracture 16, such that the at least a portion of the connecting fracture 16 is the entirety of the connecting fracture 16. In some embodiments, for example, after the hydraulic fracturing, the connecting fracture 16 may become pinched after it has been generated, thereby at least derogating from the functioning of the entirety of the connecting fracture 16 as a fluid conductor. In such cases, the upper well production fluid passage network 18 only includes an upper portion of the connecting fracture 16. A fracture, that has been effecting fluid communication between two spaces (for example between the upper and lower wells 10, 12), is said to be pinched after formation pressure effects closure of the fracture such that fluid communication between the two spaces becomes sealed or substantially sealed.

The network-disposed liquid material, as well as the fracture-disposed liquid material 20, includes the liquid treatment material, and may also include, for example, connate water, dissolved minerals, and dissolved gases, and may also include various gases and solids that are disposed in suspension, including gaseous hydrocarbon material 22 that is being conducted through the fracture-disposed liquid material 20 by buoyancy forces (see below).

The disposition of the fracture-disposed liquid material 20 assists in maintaining the connecting fracture portion in an open condition (and resisting closure of the fracture by formation pressure such that the fracture becomes "pinched") such that a fluid passage is maintained that facilitates conduction of gaseous hydrocarbon material 22 (see below), that is being conducted into the connecting fracture portion, to the upper well 10 via the connecting fracture portion (and through the fracture-disposed fluid within the connecting fracture portion), and subsequent production via the upper well 10. Once the fracture-disposed liquid material 20 becomes depleted within the connecting fracture 16 (such as by permeation into the formation 14, imbibition or by conduction into offsetting wells), such that its level within the connecting fracture 16 is lowered, there is greater risk that the connecting fracture 16 may become pinched off.

Liquid treatment material may also be supplied, via the lower well 12, to a subterranean formation 14 including one or more pre-existing connecting fractures 16 extending from the lower well 12 to the upper well 10. The supplying is such that the supplied liquid treatment material becomes disposed within the one or more connecting fractures 16, and such that stimulation of the formation 14 is effected by the supplied liquid treatment material disposed within the one or more connecting fractures 16. The stimulation includes stimulating of the conducting of the gaseous hydrocarbon material 22 of the formation 14 into one or more connecting fractures 16, each of which extend from the lower well 12 to the upper well 10. In some embodiments, for example, the connecting fractures 16 include one or more naturally occurring fractures. The liquid treatment material may include acids (in the case of acid stimulation or "acidization").

In effecting the treatment, at least a fraction of the supplied liquid treatment material becomes disposed within an upper well production fluid passage network 18 to define network-disposed liquid material. The upper well production fluid passage network 18 includes at least a portion of the connecting fracture 16 and the upper well 10. In this respect, the upper well production fluid passage network 18 is at least partially filled with fracture-disposed liquid material 20, such that the network-disposed liquid material includes the fracture-disposed liquid material 20. In some cases, such as for a time period immediately after the suspension of the supplying of the liquid treatment material to the formation 14, the network-disposed liquid material may also be disposed in the upper well 10. In operation, the upper well production fluid passage network 18 receives the gaseous hydrocarbon material 22 and effects production of the received at least gaseous hydrocarbon material.

In some embodiments, for example, the upper well production fluid passage network 18 includes the entirety of the connecting fracture 16, such that the at least a portion of the connecting fracture 16 is the entirety of the connecting fracture. In some embodiments, for example, after the stimulation, the connecting fracture 16 may become pinched after it has been generated, thereby at least derogating from the functioning of the entirety of the connecting fracture as a fluid conductor for conducting of gaseous hydrocarbon material 22 to the upper well 10. In such cases, the upper well 10 production fluid passage network 18 only includes an upper portion of the connecting fracture 16.

As indicated above, the network-disposed liquid material, as well as the fracture-disposed liquid material 20, includes the liquid treatment material, and may also include, for example, connate water, dissolved minerals, and dissolved gases, and may also include various gases and solids that are disposed in suspension, including gaseous hydrocarbon material 22 that is being conducted through the fracture-disposed liquid material 20 by buoyancy forces (see below).

The disposition of the fracture-disposed liquid material 20 within the connecting fracture portion assists in maintaining the connecting fracture portion in an open condition (and resisting closure of the fracture by formation pressure such that the fracture becomes "pinched off") such that a fluid passage is maintained that facilitates conduction of gaseous hydrocarbon material 22 (see below), that is being conducted into the connecting fracture portion, to the upper well 10 via the connecting fracture portion (and through the fracture-disposed liquid material 20 within the connecting fracture portion), and subsequent production via the upper well. Once the fracture-disposed liquid material 20 becomes depleted within the connecting fracture 16 (such as by permeation or imbibition into the formation 14, or by conduction into offsetting wells), such that its level within the connecting fracture is lowered, there is greater risk that the connecting fracture may become pinched off.

In some embodiments, for example, the supplying of the liquid treatment material, to the hydrocarbon-comprising formation 14 via the lower well 12, that effects hydraulic fracturing of the formation 14, also effects stimulation of the formation 14, which includes stimulation of the conducting of the gaseous hydrocarbon material 22 of the reservoir 15 into one or more of the connecting fractures.

In some embodiments, for example, the lower well 12 includes a cased wellbore, and the supplying of the liquid treatment material, to the formation 14 via the lower well 12 is effected through ports provided within the casing of the lower well. In some embodiments, for example, the ports can be open and closed by a sliding sleeve that is shifted by a shifting tool that is deployable downhole within the lower well.

The gaseous hydrocarbon material 22 that is conducted into the connecting fracture 16 (generated or pre-existing) may be produced through the upper well production fluid passage network 18. In this respect, in some embodiments, for example, while the upper well production fluid passage network 18 is at least partially filled with network-disposed liquid material, some of the gaseous hydrocarbon material 22 that is conducted into the connecting fracture 16 is conducted upwardly within the upper well production fluid passage network 18, through the network-disposed liquid material, by at least buoyancy forces, and then produced via the upper well 10 in response to an established pressure differential (such as that established by communication of the upper well 10 with the atmosphere). At a gas-liquid interface 24 that has been established within the upper well production fluid passage network 18, the upwardly conducted gaseous hydrocarbon material 22 is conducted across the gas-liquid interface 24 and becomes disposed above the gas-liquid interface 24. Referring to FIG. 1, in some embodiments, for example, the gaseous hydrocarbon material 22 that is received within the connecting fracture portion is conducted upwardly through the network-disposed liquid material within the upper well production fluid passage network 18, such as, for example, through the connecting fraction portion, into the upper well 10, and across the gas-liquid interface 24, by at least buoyancy forces. In some embodiments, for example, the gaseous hydrocarbon material 22 that becomes disposed above the gas-liquid interface 24 may collect above the gas-liquid interface 24, such as, for example, when the upper well 10 is shut in, and prior to the producing of the gaseous hydrocarbon material 22 via the upper well 10. This phenomenon may be characterized as "gas rollover". In some embodiments, for example, the gaseous hydrocarbon material 22 that becomes disposed above the gas-liquid interface 24, such as the gaseous hydrocarbon material 22 which collected above the gas-liquid interface 24 may be produced via the upper well 10 in response to a pressure differential (such as that established by fluidly communicating the upper well 10 with the atmosphere).

Figure 5:
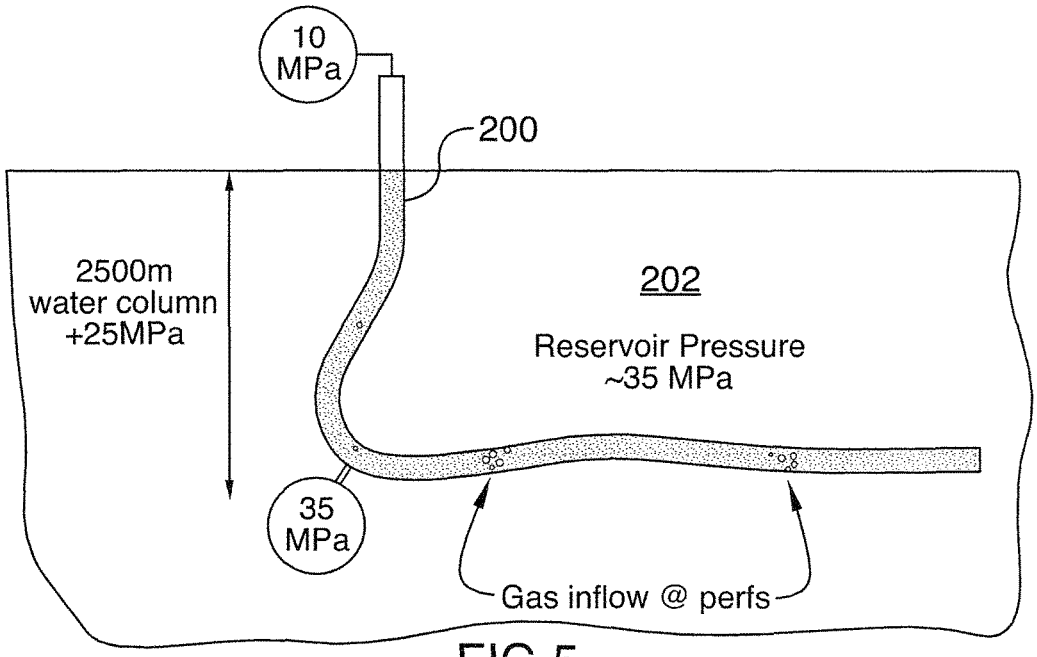
Figure 6:
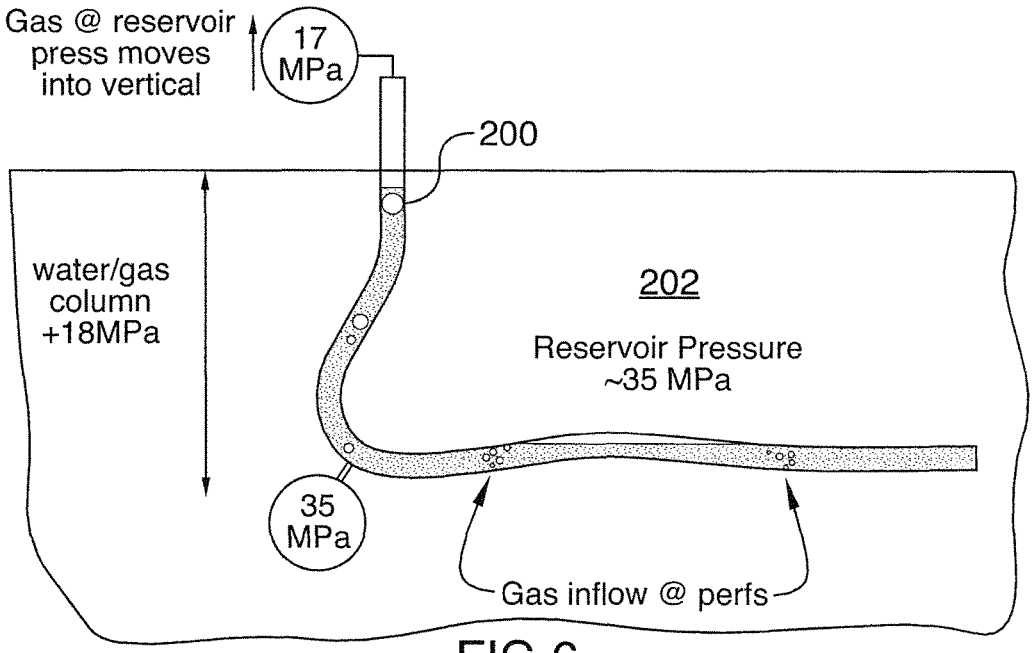
Figure 7:
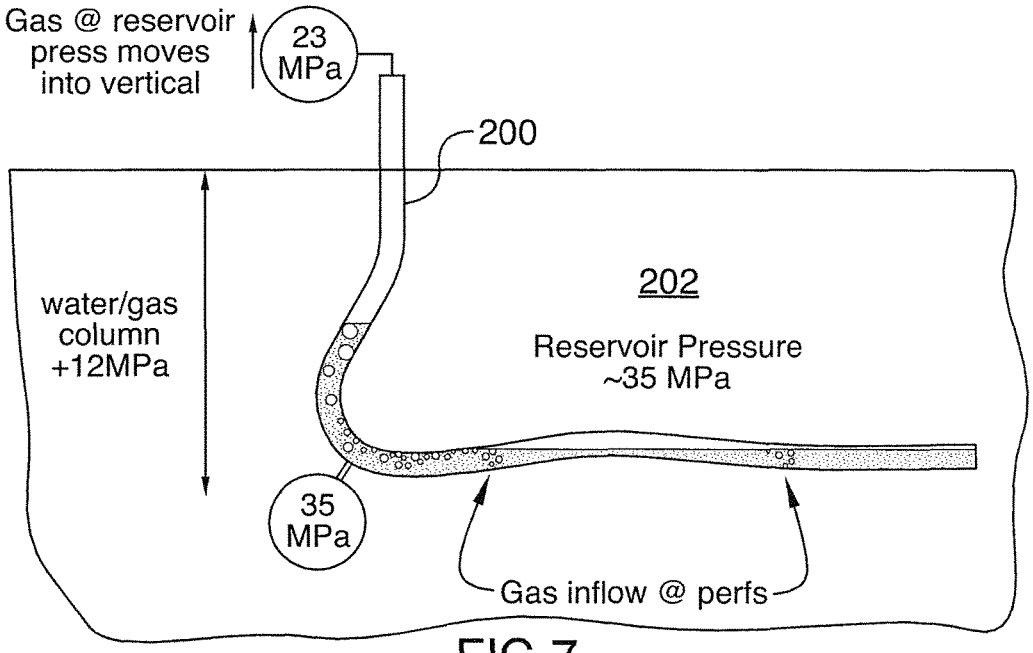
Figure 8:
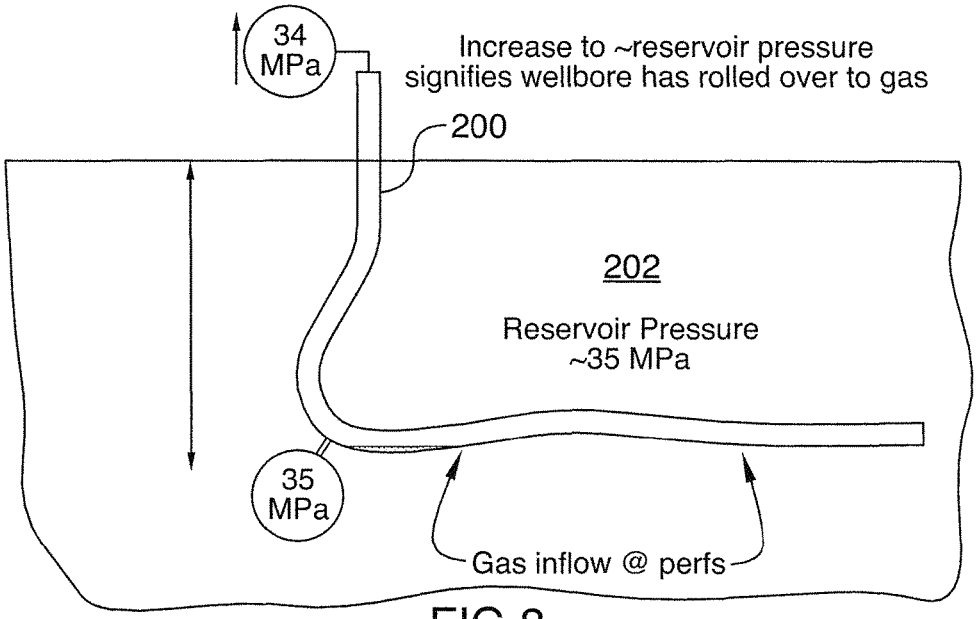

The gas rollover phenomenon is further explained and illustrated in FIGS. 4 to 8, within the context of a well 200 that has supplied liquid treatment material to the subterranean formation 202 through perforations within the casing that is lining the well, with such supplying then suspended, and after the suspension of the supplying, such well receiving ingress of gaseous hydrocarbon material from the formation via a fracture within the formation that extends to the well. In FIG. 5, the supplying of liquid treatment material has been suspended, the fluid passage defined by the well 200 is occupied with liquid treatment material, and the gaseous hydrocarbon material is migrating into the well through the perforations. In FIG. 6, the received gaseous hydrocarbon material is rising upwardly within the well 200, by virtue of at least buoyancy forces, and begins to collect at the top of the well, since the well is shut in. As the gaseous hydrocarbon material rises within the well, the gaseous hydrocarbon material expands, due to a reduction in hydrostatic pressure, such that, the collection of such expanded gaseous hydrocarbon material at the top of the well effects a progressive lowering of the gas-liquid interface. Referring to FIG. 7, after a period of time, sufficient gaseous hydrocarbon material has collected at the top of the well 200 such that the gas-liquid interface has noticeably dropped. Gaseous hydrocarbon material continues to collect above the gas-liquid interface, resulting in further lowering of the gas-liquid interface until relatively little liquid is present within the well 200, such that flow of gaseous hydrocarbon material from the formation and into the well is relatively unimpeded by any liquid disposed within the well, as illustrated in FIG. 8.

By positioning the horizontal portion 10A of the upper well 10 above the horizontal portion 12A of the lower well 12, the upper well 10 is disposed for receiving (or "capturing") the gaseous hydrocarbon material 22 that is being conducted into the connecting fracture portion, and through the network-disposed liquid material (by at least buoyancy forces), which includes the fracture-disposed liquid material 20 that is maintaining the connecting fracture in the open condition. Without having an upper well 10 that is disposed in fluid communication with the fracture extending from the lower well 12 (such fracture becoming the "connecting fracture" 16 upon its extension to, or intersection with, the upper well 10), the gaseous hydrocarbon material 22 being so conducted may remain stranded in the reservoir 15, and left unproduced.

Figure 3:
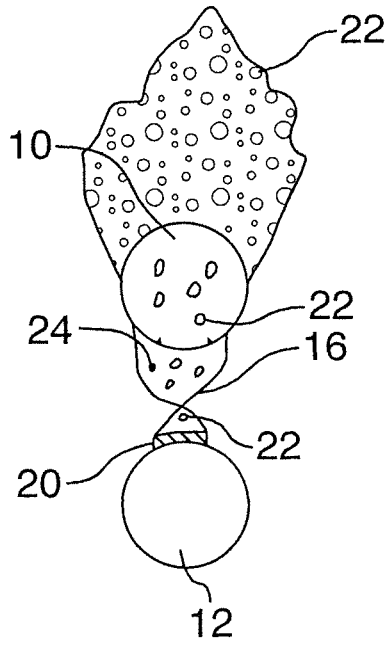
FIG. 3 is a schematic illustration of a view from the toe of the upper and lower wells illustrated in FIG. 1, and similar to FIG. 2, with the exception that the connecting fracture 16 having become pinched off.
Figure 4:
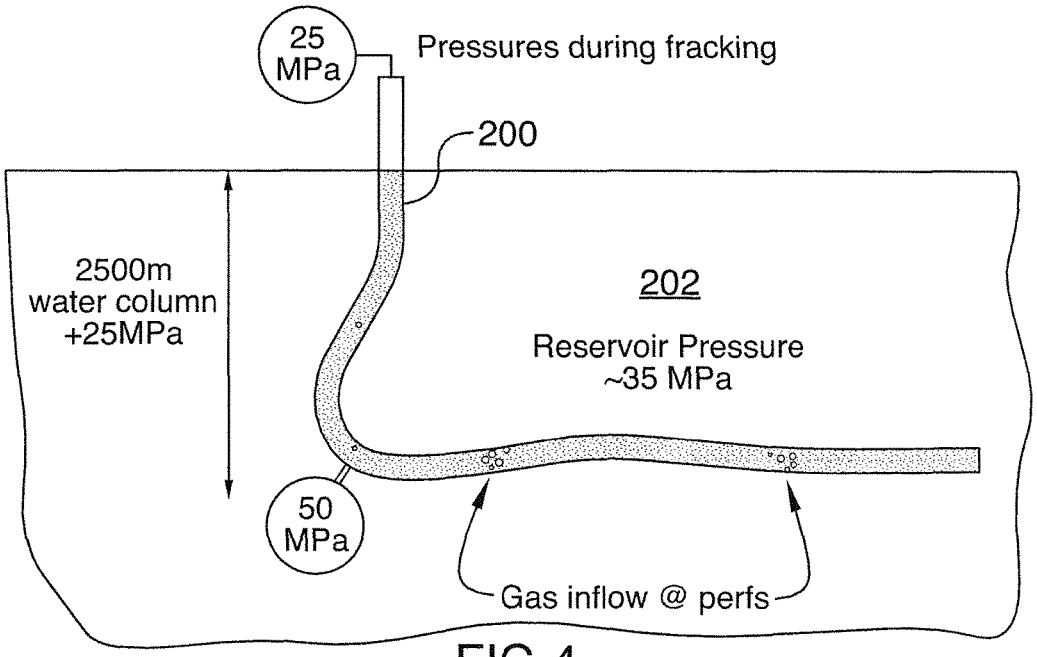
FIGS. 4 to 8 illustrate gas rollover within a well that has supplied liquid treatment material to the subterranean formation through perforations within the casing that is lining the well, with such supplying then suspended, and after the suspension of the supplying, such well receiving ingress of gaseous hydrocarbon material from the formation via a fracture within the formation that extends to the well.

As well, by positioning the horizontal portion 10A of the upper well 10 above the horizontal portion 12A of the lower well 12, the upper well 10 remains disposed for receiving the gaseous hydrocarbon material 22 that is being conducted through at least an upper section of the connecting fracture 16, even after lower sections of the connecting fracture become pinched such that fluid communication between these pinched-off sections and the upper well 10 becomes sealed or substantially sealed (see FIG. 3). Without having an upper well 10 that is disposed in fluid communication with an upper portion of a fracture that is extending from the lower well, the gaseous hydrocarbon material 22 within the fracture, above these pinched-off sections (such as the upper portion of the fraction), may become stranded.

Of course, an alternative would be to effect supplying of hydraulic fracturing fluid to the formation 14 via the upper well 10 so as to effect hydraulic fracturing of the formation 14 in the vicinity of the upper well 10, and thereby increase the probability of interconnecting the upper and lower wells 10, 12 via a fracture network. However, this would entail additional expense and potentially increased environmental impact with the additional hydraulic fracturing fluid.

In some embodiments, for example, a plurality of fractures extend from the upper well 10, and one or more of these fractures are upper well-generated fractures, in that the fractures have been generated by hydraulic fracturing of the formation 14 effected by the supplying of hydraulic fracturing fluid to the formation 14 via the upper well 10. In this respect, the ratio of upper well-generated fractures to the connecting fractures is less than 1:5, such as less than 1:10. This ratio is representative of providing a well, through which an insubstantial degree of hydraulic fracturing has been effected such that the above-described benefits of primarily fracturing via the lower well 12 are still realized.

In some embodiments, for example, the upper well 10 is a non-stimulated upper well. In this context, the non-stimulated upper well 10 is a well 10 that prior to producing of the gaseous hydrocarbon material, has not supplied any liquid treatment material, or has supplied substantially no liquid treatment material, to the formation 14.

In some embodiments, for example, the upper well 10 is a relatively unstimulated upper well. In this context, the relatively unstimulated upper well 10 is a well 10 that, prior to the producing of gaseous hydrocarbon material 22 via the well, supplies liquid treatment material to the formation 14 such that the total volume of liquid treatment material supplied to the formation 14 by the upper well 10 during the supplying by the upper well 10 is less than 40% of the total volume of liquid treatment material supplied to the formation 14 by the lower well 12 during the supplying by the lower well. In some of these embodiments, for example, the total volume of liquid treatment material supplied to the formation 14 by the upper well 10 during the supplying by the upper well 10 is less than 30% of the total volume of liquid treatment material supplied to the formation 14 by the lower well 12 during the supplying by the lower well. In some of these embodiments, for example, the total volume of liquid treatment material supplied to the formation 14 by the upper well 10 during the supplying by the upper well 10 is less than 25% of the total volume of liquid treatment material supplied to the formation 14 by the lower well 12 during the supplying by the lower well.

As the gaseous hydrocarbon material 22 is being conducted upwardly within the upper well 10 production fluid passage network 18, the gaseous hydrocarbon material 22 is expanding. This is because the formation 14 pressure is decreasing as the gaseous hydrocarbon material 22 is becoming disposed closer to the surface. While the upper well 10 is not producing, or not substantially producing the received gaseous hydrocarbon material 22 (i.e. the upper well is "shut in"), as this expanding gaseous hydrocarbon material 22 is either: (a) conducted vertically within the upper well 10 production fluid passage network 18 and, at its uppermost vertical extent, escapes the network-disposed liquid material and creates a gaseous hydrocarbon material headspace such that the gas-liquid interface 24 becomes defined, or (b) conducted vertically within the upper well 10 production fluid passage, across the gas-liquid interface 24, and is collected within the upper well production fluid passage network 18 above the gas-liquid interface 24, the expanding gaseous hydrocarbon material 22 forces the gas-liquid interface 24 downwardly, resulting in loss of the fracture-disposed liquid material 20 from the connecting fracture portion, and, while the lower well is shut in (i.e. not producing, or not substantially producing material from the well), to a permeable zone, (for example, such as by imbibition) or to fluidly connecting offsetting wells. By having the gas-liquid interface 24 move downwardly, a greater portion of the upper well 10 production fluid passage network 18, becomes relatively less obstructed to conducting of gaseous hydrocarbon material 22 (because of the absence of the fracture-disposed liquid material 20, this thereby provides conditions for an increased rate of production of the gaseous hydrocarbon material 22 via the upper well). In some embodiments, for example, the collecting of the gaseous hydrocarbon material 22 above the gas-liquid interface 24 is effected at least until the gas-liquid interface 24 becomes disposed within the connecting fracture 16.

In some embodiments, for example, in order to provide sufficient time for gaseous hydrocarbon material 22 to migrate through the network-disposed liquid material and collect above the gas-liquid interface 24 such that the gas-liquid interface 24 becomes sufficiently lowered, while the fracture-disposed liquid material 20 is maintaining the connecting fracture in the open condition, and after the supplying of the liquid treatment material to the subterranean formation via the lower well, the process further includes shutting in the lower well 12 (such that there is no producing or substantial producing via the lower well 12). In some embodiments, for example, the shutting in of the lower well 12 is effected after the supplying of the liquid treatment material, and at least while the collecting is being effected after the supplying of the liquid treatment material, and prior to the gas-liquid interface becoming disposed within the connecting fracture in response to the collecting. In some embodiments, for example, the shutting in is effected prior to the producing, or substantial producing, via the upper well 10 (i.e. while the upper well 10 is disposed in a shut in condition).

By having the lower well 12 disposed in the shut-in condition, fluid communication between the connecting fracture and the surface facilities is sealed, or substantially sealed, thereby at least temporarily sealing, or substantially sealing, a potential flowpath for conducting of the fracture-disposed liquid material 20 from the connecting fracture 16, which would otherwise effect depletion of the fracture-disposed liquid material 20 from within the connecting fracture 16, and thereby removing resistance being offered by such fracture-disposed liquid material, to formation pressure which is biasing the closure of the connecting fracture, and increasing the likelihood that the connecting fracture would become pinched and thereby limiting establishment of a sufficiently meaningful flowpath, unimpeded, or substantially unimpeded, by fracture-disposed liquid material 22, from the reservoir 15 to the upper well 10. In some of these embodiments, for example, the producing via the upper well 10 may be delayed until sufficient collecting of the gaseous hydrocarbon material 22 has been effected such that the gas-liquid interface 24 becomes lowered such that it becomes disposed within the connecting fracture 16. In this respect, after sufficient collecting of the gaseous hydrocarbon material 22 has been effected such that the gas-liquid interface 24 becomes lowered, and such that the gas-liquid interface 24 becomes disposed within the connecting fracture, producing of fluid disposed within the connecting fracture may be effected, via the upper well 10. In some of these embodiments, for example, while the producing is being effected via the upper well 10, the lower well 12 continues to remain shut in. By having the lower well 12 continuing to remain shut in while the producing is being effected via the upper well, risk of pinching off within the connecting fracture 16 continues to be mitigated, for at least the reasons described above.

In some embodiments, for example, in order to remove the fracture-disposed liquid material 20 from the connecting fracture, and thereby at least reduce interference (otherwise provided by the fracture-disposed liquid material 20 that would be within the connecting fracture) to the conducting of the gaseous hydrocarbon material 22 (that has been conducted into the connecting fracture) through the connecting fracture, after the supplying of the liquid treatment material, and prior to production, or substantial production of at least gaseous hydrocarbon material 22 via the upper well 10, fracture-disposed liquid material 20 is produced through the lower well 12. Production of the fracture-disposed liquid material through the lower well 12 may be effected by artificial lift (such as by a downhole pump or gas lift), and may also be assisted by pressure of the fracture-disposed liquid material.

Figure 9:
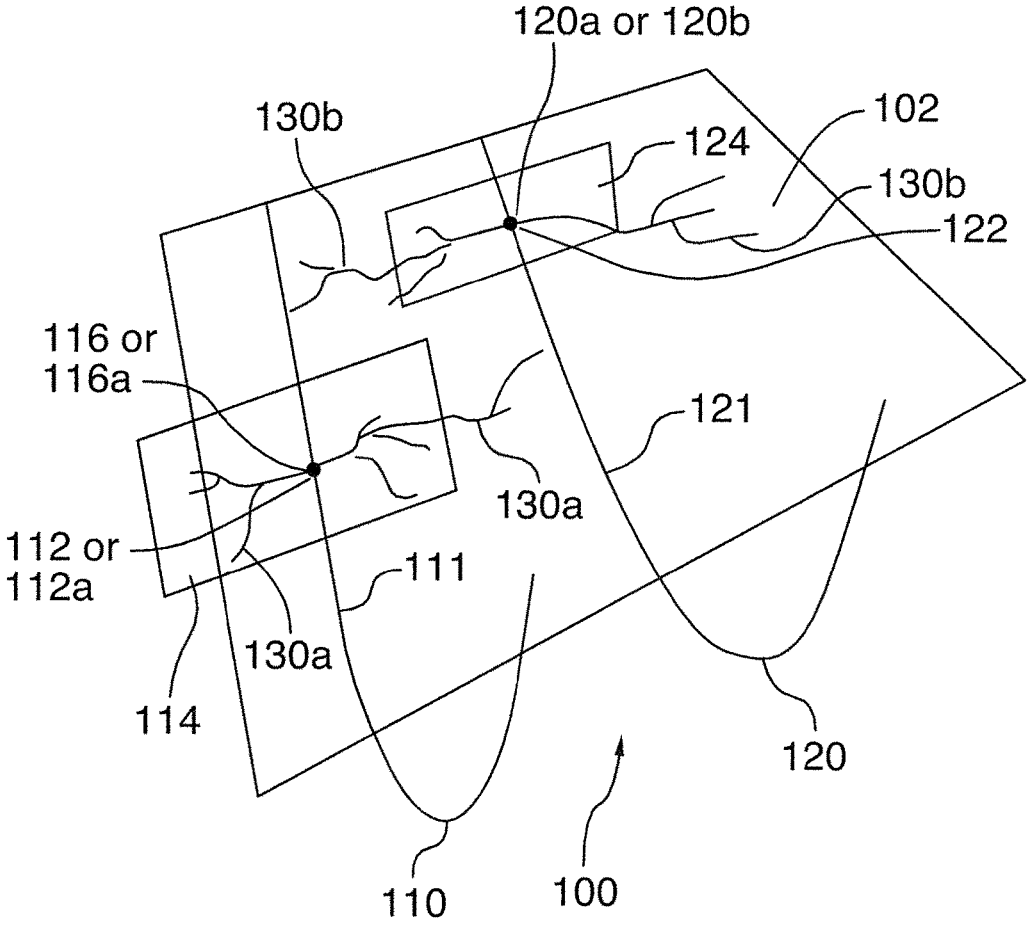
FIG. 9 is a schematic illustration of a perspective view of an embodiment of a system used to implement another aspect of the process within a subterranean formation.

Referring to FIG. 9, in another aspect, there is provided a process for producing gaseous hydrocarbon material from a subterranean formation 102. The process is enabled by a system 100 that includes at least two wells 110, 120. The process includes supplying a treatment fluid (such as a liquid treatment material) to a subterranean formation via a first well 110, and supplying a treatment fluid (such as a liquid treatment material) to the subterranean formation via a second well 120. Each one of the first and second wells, independently, includes a horizontal portion 111, 121. The horizontal portion 111 of the first well 110 is spaced apart from the horizontal portion 121 of the second well 120 by a minimum distance of at least 15 meters (such as, for example, at least 25 meters, such as, for example, between 15 meters and 1500 meters). The locations, at which the supplying via the first and second wells is effected, is co-ordinated so that it is less likely for there to be a redundancy in the supplying of the treatment fluid via the first and second wells (i.e., the treatment fluid supplied from one well is less likely to become disposed within the same zone of the subterranean formation within which treatment fluid supplied from the other well becomes disposed), and thereby result in a reduction in the volume of treatment fluid required to effect the necessary stimulation of the formation in order to effect production of gaseous hydrocarbon material from a reservoir 15 disposed within the formation.

In some embodiments, for example, the supplying of the treatment fluid via the first well 110 to the subterranean formation 102, is at a first injection point 112 that is disposed within the subterranean formation at an interface with the first well 110. The first injection point is disposed within a first vertical plane 114. The supplying of the treatment fluid via the second well to the subterranean formation is at one or more second injection points 122. Each one of the one or more second injection points, independently, is disposed: (a) within the subterranean formation at an interface with the second well, and (b) within a second vertical plane 124. The first and second vertical planes 114, 124 are disposed in parallel relationship relative to one another. The first vertical plane 114 is spaced apart from the closest second vertical plane 124 by a minimum distance of at least 25 meters. In some of these embodiments, for example, the first vertical plane 114 is spaced apart from the closest second vertical plane by a minimum distance of at least 35 meters, such as at least 50 meters. In some embodiments, for example, the first injection point 112 is defined at an interface with a port of a casing that is lining the first well, and each one of the one or more second injection points 122, independently, is defined at a respective interface with a port of a casing that is lining the second well. In some embodiments, for example, the first injection point 112 is disposed at an interface with a horizontal portion 111 of the first well 110, and each one of the one or more second injection points 122, independently, is disposed at an interface with a horizontal portion 121 of the second well 120.

In some embodiments, for example, the supplying of the treatment fluid via a first well 110 to the subterranean formation 102 is at a plurality of first injection points 112, and each one of the first injection points, independently, is disposed: (a) within the subterranean formation at a respective interface with the first well, and (b) within a respective first vertical plane 114. In this respect, a plurality of first vertical planes 114 is defined. The supplying of treatment fluid, via a second well 120 to the subterranean formation, is at a plurality of second injection points 122, and each one of the second injection points, independently, is disposed: (a) within the subterranean formation at a respective interface with the second well, and (b) within a respective second vertical plane, such that a plurality of second vertical planes 124 is defined. The first and second vertical planes 114, 124 are disposed in parallel relationship relative to one another. At least one staggered first injection point 112*a* is defined. Each one of the at least one staggered first injection point 112*a*, independently, is a first injection point having a respective first vertical plane that is spaced apart from the closest second vertical plane 124 by a minimum distance of at least 25 meters. At least 75% of the total volume of treatment fluid, that is supplied to the formation via the first well 10, is supplied at the at least one staggered first injection point 112*a*. In some embodiments, for example, at least 80%, such as, for example, at least 90%, of the total volume of treatment fluid, that is supplied to the formation via the first well 110, is supplied at the at least one staggered first injection point 112*a*. In some embodiments, for example, the supplying of the treatment fluid to at least one of the first injection points 112 is effected asynchronously relative to the supplying of the treatment fluid to at least another one of the first injection points 112. In some embodiments, for example, the supplying of the treatment fluid to at least one of the second injection points 122 is effected asynchronously relative to the supplying of the treatment fluid to at least another one of the second injection points 122. In some embodiments, for example, the supplying of the treatment fluid to at least one of the first injection points 112 is effected asynchronously relative to the supplying of the treatment fluid to at least one of the second injection points 122 In some embodiments, for example, for each one of the at least one staggered first injection point 112*a* independently, the first vertical plane 114 is spaced apart from the closest second vertical plane 124 by a minimum distance of at least 35 meters, such as, for example, at least 50 meters. In some embodiments, for example, each one of the first injection points 112, independently, is defined at an interface with a port of a casing that is lining the first well, and each one of the second injection points 122, independently, is defined at an interface with a port of a casing that is lining the second well. In some embodiments, for example, each one of the first injection points 112, independently is disposed at an interface with a horizontal portion 111 of the first well 110, and each one of the second injection points 122, independently, is disposed at an interface with a horizontal portion 121 of the second well 120.

In some embodiments, for example, the supplying of treatment fluid, via a first well 110 to the subterranean formation 102, is through a first port 116 defined within a casing that is lining the first well. The first port 116 is disposed within a first vertical plane 114. The supplying of treatment fluid, via a second well 120 to the subterranean formation 102, is through one or more second ports 126 defined within a casing that is lining the second well. Each one of the one or more second ports 126, independently, is disposed within a second vertical plane 124. The first and second vertical planes 114, 124 are disposed in parallel relationship relative to one another. The first vertical plane 114 is spaced apart from the closest second vertical plane 124 by a minimum distance of at least 25 meters, such as, for example, at least 35 meters, such as, for example, at least 50 meters. In some embodiments, for example, the first port is disposed within a horizontal portion 111 of the first well 110, and each one of the one or more second ports, independently, is disposed within a horizontal portion 121 of the second well 120.

In some embodiments, for example, the supplying of treatment fluid, via a first well 110 to the subterranean formation 102, is through a plurality of first ports 116 defined within a casing that is lining the first well. Each one of the first ports 116, independently, is disposed within a respective first vertical plane 114, such that a plurality of first vertical planes 114 is defined. The supplying of treatment fluid, via a second well 120 to the subterranean formation 102, is through a plurality of second ports 126 defined within a casing that is lining the second well. Each one of the second ports 126, independently, is disposed within a respective second vertical plane 126, such that a plurality of second vertical planes 126 is defined. The first and second vertical planes 114, 124, are disposed in parallel relationship relative to one another. At least one staggered first port 116*a* is defined. Each one of the at least one staggered first port 116*a*, independently, is a first port 116 having a respective first vertical plane 114 that is spaced apart from the closest second vertical plane 126 by a minimum distance of at least 25 meters. At least 75% of the total volume of treatment fluid, that is supplied to the formation via the first well 110, is supplied through the at least one staggered first port 116*a*. In some embodiments, for example, at least 80%, such as, for example, at least 90%, of the total volume of treatment fluid, that is supplied to the formation via the first well 110, is supplied through the at least one staggered first port 116*a*. In some embodiments, for example, the supplying of the treatment fluid through at least one of the first ports 116 is effected asynchronously relative to the supplying of the treatment fluid through at least another one of the first ports 116. In some embodiments, for example, the supplying of the treatment fluid through at least one of the second ports 126 is effected asynchronously relative to the supplying of the treatment fluid through at least another one of the second ports 126. In some embodiments, for example, the supplying of the treatment fluid through at least one of the first ports 116 is effected asynchronously relative to the supplying of the treatment fluid through at least one of the second ports 126. In some embodiments, for example, for each one of the at least one staggered first port 116*a*, independently, the first vertical plane is spaced apart from the closest second vertical plane by a minimum distance of at least 35 meters, such as, for example, at least 50 meters. In some embodiments, for example, each one of the first ports 116 is disposed within a horizontal portion 111 of the first well 110, and each one of the second ports 122 is disposed within a horizontal portion 121 of the second well 120.

In some embodiments, for example, the supplying of the treatment fluid effects production of a connecting fracture, wherein the connecting fracture extends from the first well 110 to the second well 120. In this respect, in some embodiments, for example, after supplying of the treatment fluid, via the first well 110 to the subterranean formation 102, at a first injection point 112, or through a first port 116 (the first injection point, or the first port, being disposed within a first vertical plane 114), such that the supplying effects the production of a connecting fracture 130*a* extending from the first well 110 to the second well 120, gaseous hydrocarbon material is produced via the second well. After the producing of the gaseous hydrocarbon material via the second well 120, treatment fluid is supplied via the second well to the formation, at a second injection point 122, or through a second port 126, such that the supplying effects the production of a connecting fracture 130*b* extending from the second well 120 to the first well 110. The second injection point 122, or the second port 126, through which the supplying to the subterranean formation 102, via the second well 120, is effected, is disposed within a second vertical plane 124. The first and second vertical planes 114, 124 are disposed in parallel relationship relative to one another. The second vertical plane 124 is spaced apart from the closest first vertical plane 114 by a minimum distance of at least 25 meters, such as, for example, at least 35 meters, such as, for example, at least 50 meters. After the supplying of treatment fluid via the second well 120 such that the connecting fracture is established, gaseous hydrocarbon material is produced via the first well 110. It is understood that the order of operations involving the supplying of treatment fluid and the producing of gaseous hydrocarbon material may be altered.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A process for producing gaseous hydrocarbon material from a subterranean formation, comprising:

hydraulically fracturing the subterranean formation with a liquid treatment material such that at least one connecting fracture is generated, wherein the at least one connecting fracture extends from a lower well to an upper well, wherein at least a fraction of the liquid treatment material becomes disposed within an upper well production fluid passage network including the upper well and at least an upper portion of the at least one connecting fracture, wherein a gas-liquid interface is defined within the upper well production fluid passage network, wherein in response to the hydraulic fracturing, gaseous hydrocarbon material is received within the upper portion of the at least one connecting fracture and is conducted upwardly through the liquid treatment material, by at least buoyancy forces, and across the gas-liquid interface; and producing the gaseous hydrocarbon material from above the gas-liquid interface within the upper well production fluid passage network, via the upper well.

2. The process as claimed in claim 1;

wherein the producing is effected in response to an established pressure differential.

3. The process as claimed in claim 1;

wherein the hydraulic fracturing is effected by supplying liquid treatment material to the subterranean formation via the lower well.

4. The process as claimed in claim 3;

wherein the hydraulic fracturing generates a plurality of connecting fractures and a plurality of upper well-generated fractures;

wherein the plurality of connecting fractures are generated by hydraulic fracturing of the subterranean formation by supplying of the liquid treatment to the subterranean formation via the lower well;

and wherein the plurality of upper well-generated fractures are generated by hydraulic fracturing of the formation by supplying of the liquid treatment material to the subterranean formation via the upper well;

and wherein the ratio of the plurality of upper well-generated fractures to the plurality of connecting fractures is less than 1:5.

5. The process as claimed in claim 3;

wherein prior to the producing of gaseous hydrocarbon material via the upper well, the liquid treatment material is supplied to the subterranean formation such that an upper well volume of the supplied liquid treatment material is less than 40% of a lower well volume of the liquid treatment material supplied to the subterranean formation by the lower well.

6. The process as claimed in claim 1;

wherein prior to producing of the gaseous hydrocarbon material, the upper well has not supplied the liquid treatment material to the subterranean formation.

7. The process as claimed in claim 1, further comprising:

collecting the received gaseous hydrocarbon material above the gas-liquid interface, prior to producing the gaseous hydrocarbon material via the upper well.

8. The process as claimed in claim 7;

wherein the collecting of the gaseous hydrocarbon material lowers the gas-liquid interface within the upper well production fluid passage network.

9. The process as claimed in claim 8;

wherein the collecting of the gaseous hydrocarbon material is effected at least until the gas-liquid interface becomes disposed below the upper well within the connecting fracture.

10. A process for producing a gaseous hydrocarbon material from a subterranean formation, comprising:

providing a lower well and an upper well;

supplying liquid treatment material to the subterranean formation via the lower well to effect hydraulic fracturing of the subterranean formation wherein a connecting fracture extends from the lower well to the upper well, wherein an upper well production fluid passage network is provided that includes the upper well and the connecting fracture, and wherein the liquid treatment material is disposed within the upper well production fluid passage network;

collecting the gaseous hydrocarbon material above a gas-liquid interface created by upward conducting of the gaseous hydrocarbon material through the liquid treatment material, wherein the gas-liquid interface is lowered to below the upper well within the connecting fracture; and producing gaseous hydrocarbon material via the upper well.

11. The process as claimed in claim 10;

wherein the lower well includes a horizontal portion, and wherein the supplying of the liquid treatment material to the subterranean formation is effected via the horizontal portion of the lower well;

and wherein the upper well includes a horizontal portion, and wherein the connecting fracture extends from the horizontal portion of the lower well to the horizontal portion of the upper well such that the horizontal portion of the upper well receives the gaseous hydrocarbon material;

and wherein the horizontal portion of the upper well is disposed above the horizontal portion of the lower well.

12. The process as claimed in claim 10, further comprising:

after the supplying of the liquid treatment fluid, and prior to the producing of gaseous hydrocarbon material via the upper well, producing a fracture-disposed liquid material through the lower well.

* * * * *